US009455513B2

(12) United States Patent
Yokoo

(10) Patent No.: US 9,455,513 B2
(45) Date of Patent: Sep. 27, 2016

(54) CONNECTOR HAVING STRUCTURE TO PREVENT CABLE PULL-OUT

(71) Applicant: Japan Aviation Electronics Industry, Limited, Tokyo (JP)

(72) Inventor: Hiroyuki Yokoo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/819,719

(22) Filed: Aug. 6, 2015

(65) Prior Publication Data

US 2016/0141785 A1 May 19, 2016

(30) Foreign Application Priority Data

Nov. 13, 2014 (JP) ..... 2014-230508

(51) Int. Cl.
*H01R 13/40* (2006.01)
*H01R 12/77* (2011.01)
*H01R 12/88* (2011.01)

(52) U.S. Cl.
CPC ..... *H01R 12/772* (2013.01); *H01R 12/88* (2013.01)

(58) Field of Classification Search
CPC .. H01R 12/88; H01R 12/774; H01R 23/668; H01R 23/684; H01R 23/7073; H01R 12/585; H01R 13/41; H01R 43/16
USPC ..... 439/495, 733.1, 260
See application file for complete search history.

(56) References Cited

U.S. PATENT DOCUMENTS 5,842,883 A * 12/1998 Igarashi ..... H01R 12/79 439/260
5,924,891 A * 7/1999 Benjamin ..... H01R 12/7005 439/495
6,056,572 A * 5/2000 Matsumoto ..... H01R 12/79 439/260
6,089,905 A * 7/2000 Shimmyo ..... H01R 12/79 439/260

(Continued)

FOREIGN PATENT DOCUMENTS

JP H 04-253176 A 9/1992
JP 2000-299153 A 10/2000

(Continued)

*Primary Examiner* — Chandrike Prasad
*Assistant Examiner* — Vladimir Imas
(74) *Attorney, Agent, or Firm* — Collard & Roe, P.C.

(57) ABSTRACT

A connector is connectable with a sheet-like object having a received portion. The connector comprises a terminal, a holding member and a pressing member. The holding member holds the terminal. The holding member has a regulating portion. The pressing member is supported by at least one of the terminal and the holding member so as to be movable. The pressing member is movable between an open position and a close position and is movable to the close position by being turned forward in a front-rear direction from the open position. The pressing member is provided with a receiving portion and a regulated portion. The receiving portion is positioned forward of the received portion of the object in the front-rear direction when the object is connected with the connector while the pressing member is positioned at the close position. When the pressing member is positioned at the close position, the regulated portion is positioned rearward of the regulating portion in the front-rear direction so that the regulating portion regulates forward movement of the regulated portion.

7 Claims, 11 Drawing Sheets

(56) References Cited

U.S. PATENT DOCUMENTS 6,224,418 B1 * 5/2001 Miura ..... H01R 12/79 439/260
6,293,818 B1 * 9/2001 Kim ..... H01R 12/79 439/495
6,319,033 B1 * 11/2001 Ma ..... H01R 12/79 439/260
6,352,442 B1 * 3/2002 Kudo ..... H01R 12/88 439/260
6,669,503 B2 * 12/2003 Hirose ..... H01R 12/88 439/495
7,044,773 B2 * 5/2006 Suzuki ..... H01R 12/592 439/260
7,083,455 B1 * 8/2006 Miura ..... H01R 12/774 439/260
7,179,118 B1 * 2/2007 Harlan ..... H01R 12/774 439/260
7,261,589 B2 * 8/2007 Gillespie ..... H01R 12/774 439/260
7,534,131 B2 * 5/2009 Chung ..... H01R 12/7094 439/260
7,540,764 B2 * 6/2009 Suzuki ..... H01R 12/79 439/260
7,591,661 B2 * 9/2009 Suzuki ..... H01R 12/88 439/260
7,695,311 B2 * 4/2010 Nemoto ..... H01R 12/79 439/495
7,766,680 B2 * 8/2010 Suzuki ..... H01R 12/79 439/260
7,854,625 B1 * 12/2010 Yuan ..... H01R 12/79 439/260
7,887,351 B2 * 2/2011 Wang ..... H01R 12/88 439/260
7,909,639 B2 * 3/2011 Hirata ..... H01R 12/88 439/495
8,128,429 B2 * 3/2012 Suzuki ..... H01R 12/707 439/261
8,172,592 B2 * 5/2012 Ogura ..... H01R 12/79 439/260
8,267,717 B2 * 9/2012 Ishishita ..... H01R 12/88 439/260
8,435,059 B2 * 5/2013 Honda ..... H01R 12/88 439/260
8,979,570 B2 * 3/2015 Yokoo ..... H01R 12/772 439/372
9,070,993 B2 * 6/2015 Honda ..... H01R 12/88

FOREIGN PATENT DOCUMENTS

JP 2002-367730 A 12/2002
JP 2005-056618 A 3/2005
JP 2006-147408 A 6/2006

* cited by examiner

CONNECTOR HAVING STRUCTURE TO PREVENT CABLE PULL-OUT

CROSS REFERENCE TO RELATED APPLICATIONS

An applicant claims priority under 35 U.S.C. §119 of Japanese Patent Application No. JP2014-230508 filed Nov. 13, 2014.

BACKGROUND OF THE INVENTION

This invention relates to a connector which is to be connected with a sheet-like object such as a Flexible Printed Circuit (FPC) or a Flexible Flat Cable (FFC).

With reference to FIG. 20, JP-A 2000-299153 (Patent Document 1) discloses a connector 900 having a lock portion 910 which is openable and closable. The lock portion 910 is provided with locking pieces 920. With reference to FIGS. 19 and 21, the connector 900 is connected with a cable 950 which is formed with locked protrusions 960. As shown in FIG. 19, when the connector 900 is connected with the cable 950 while the lock portion 910 is closed, the locking pieces 920 lock the locked protrusions 960, respectively. Accordingly, even if the cable 950 is moved upward or downward, the cable 950 is prevented from being removed from the connector 900.

When the cable 950 is to be pulled out horizontally from the connector 900, forces which move the locking pieces 920 upward are applied to the lock portion 910 so that the lock portion 910 might be opened.

SUMMARY OF THE INVENTION

It is therefore an object of the present invention to provide a connector having a structure which prevents an object, such as a cable, from being pulled out from the connector.

One aspect of the present invention provides a connector connectable with a sheet-like object having a received portion. The connector comprises a terminal, a holding member and a pressing member. The holding member holds the terminal. The holding member has a regulating portion. The pressing member is supported by at least one of the terminal and the holding member so as to be movable. The pressing member is movable between an open position and a close position and is movable to the close position by being turned forward in a front-rear direction from the open position. The pressing member is provided with a receiving portion and a regulated portion. The receiving portion is positioned forward of the received portion of the object in the front-rear direction when the object is connected with the connector while the pressing member is positioned at the close position. When the pressing member is positioned at the close position, the regulated portion is positioned rearward of the regulating portion in the front-rear direction so that the regulating portion regulates forward movement of the regulated portion.

When the object is connected with the connector while the pressing member is positioned at the close position, the receiving portion of the pressing member is positioned forward of the received portion of the object. Accordingly, even if the object is to be pulled out from the connector, the received portion is brought into abutment with the receiving portion so that the pulling out of the object is stopped.

In particular, when the pressing member is positioned at the close position, the regulated portion of the pressing member is positioned rearward of the regulating portion of the holding member so that the regulating portion regulates forward movement of the regulated portion. Accordingly, even if the object is to be pulled out horizontally from the connector, horizontal movement of the pressing member is regulated so that the pressing member is prevented from being opened.

Figure 1:
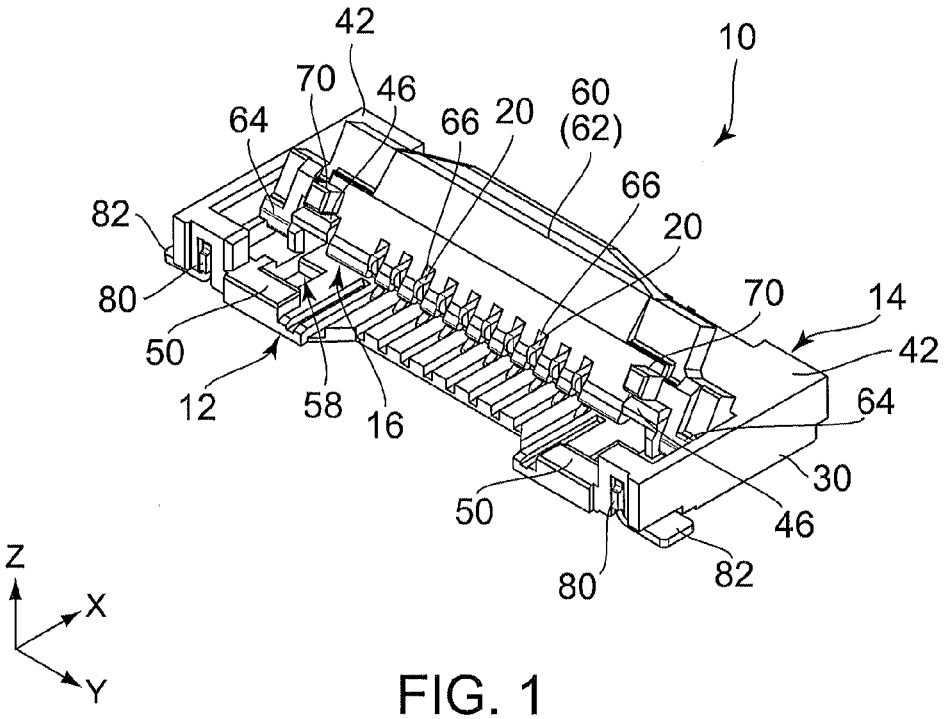
FIG. 1 is a perspective view showing a connector according to an embodiment of the present invention, wherein the illustrated pressing member is positioned at an open position.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 15:
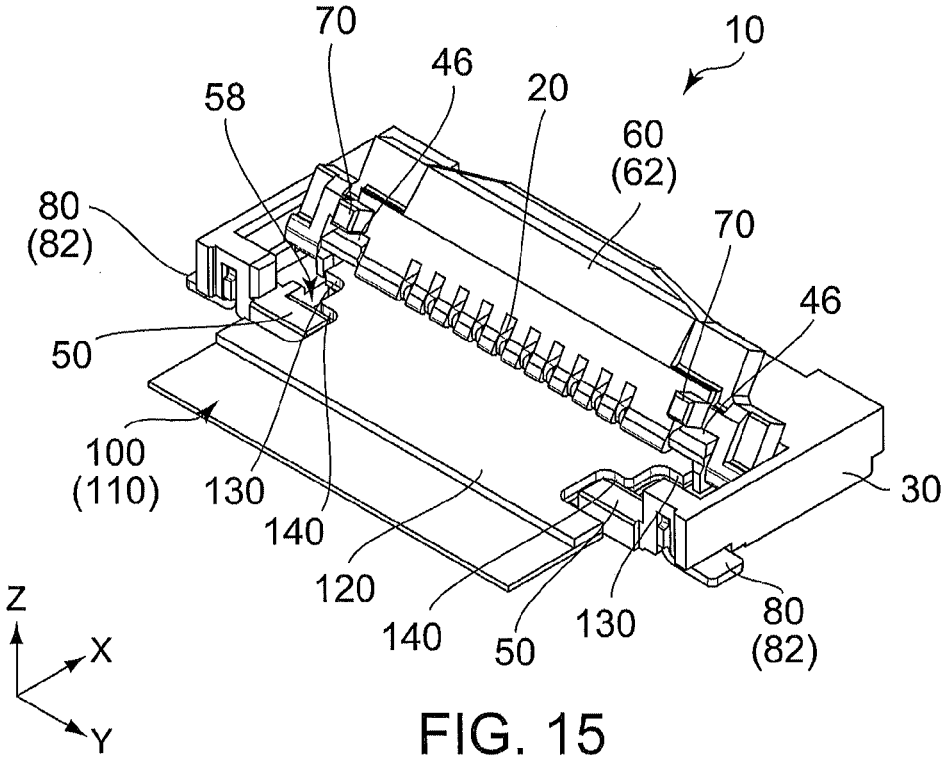
FIG. 15 is another perspective view showing the connector of FIG. 1, wherein the FPC of FIG. 14 is temporarily held by the illustrated connector.
Figure 16:
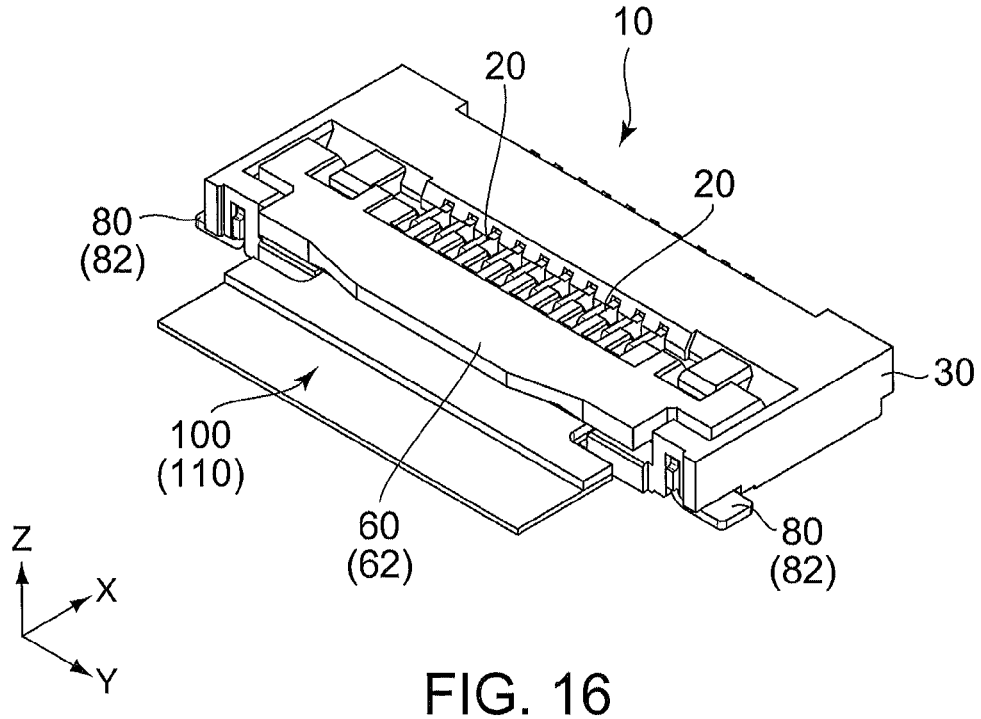
FIG. 16 is another perspective view showing the connector of FIG. 15, wherein the illustrated connector is connected with the FPC.

With reference to FIGS. 15 and 16, a connector 10 according to an embodiment of the present invention is connectable with a sheet-like object 100 such as an FPC or an FFC.

Figure 14:
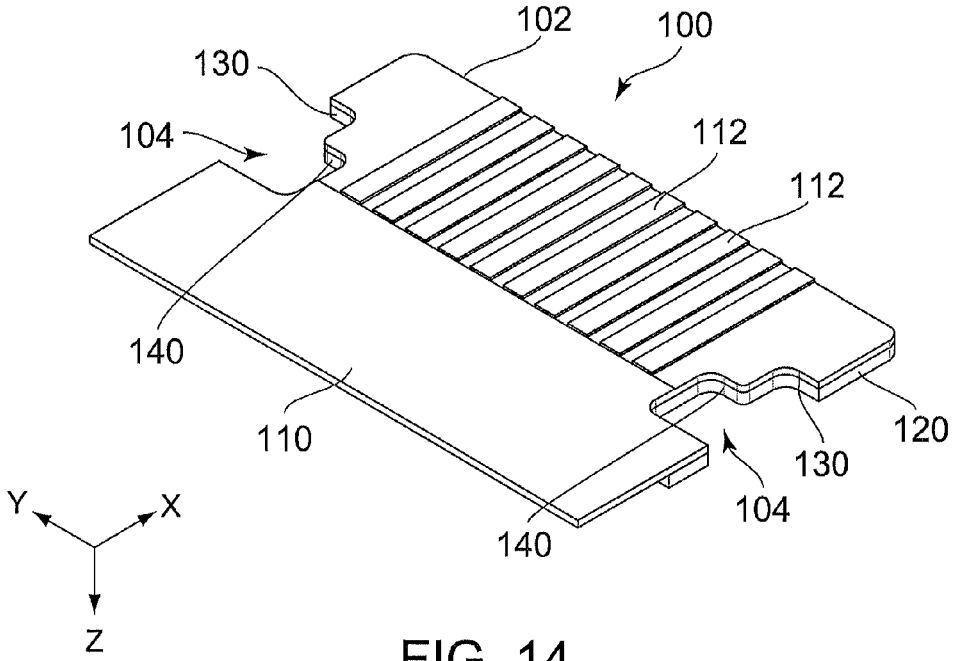
FIG. 14 is a lower perspective view showing an FPC, or an object, which is to be connected with the connector of FIG. 1.

As shown in FIG. 14, the object 100 comprises a main member 110 and a reinforcing member 120. The main member 110 has a plurality of connection portions 112, and the reinforcing member 120 reinforces the main member 110. The connection portions 112 are arranged in a pitch direction, or in a Y-direction, in the vicinity of an end portion 102 of the object 100. The reinforcing member 120 is attached to the main member 110 so as to reinforce especially a region of the main member 110 where the connection portions 112 are formed.

The object 100 is formed with recesses 104 which are inwardly recessed in steps from opposite ends thereof in the pitch direction, respectively. Each of the recesses 104 is defined by edge portions, which include two edge portions perpendicular to a front-rear direction, or an X-direction. One of the two edge portions is a received portion 130, and a remaining one thereof is a temporarily held portion 140. In other words, in the present embodiment, each pair of the received portion 130 and the temporarily held portion 140 belongs to the recess 104 corresponding thereto. However, the present invention is not limited thereto. The received portion 130 and the temporarily held portion 140, which are paired with each other, may belong to independent recesses, respectively.

Each of the received portions 130 of the present embodiment is nearer to the end portion 102 than the temporarily held portion 140 paired therewith in the front-rear direction. In other words, each of the received portions 130 is positioned between the end portion 102 and the temporarily held portion 140 paired therewith in the front-rear direction. In addition, each of the temporarily held portions 140 of the present embodiment is positioned inward of the received portion 130 paired therewith in the pitch direction. In other words, in the pitch direction, a distance between the two temporarily held portions 140 is shorter than another distance between the two received portions 130.

With reference to FIGS. 1 to 8, the connector 10 according to the present embodiment comprises a plurality of terminals 20, a holding member 30, a pressing member 60 and two holddowns 80. Each of the terminals 20 is made of metal. The holding member 30 is made of insulator. The pressing member 60 is made of insulator. Each of the holddowns 80 is made of metal.

Figure 5:
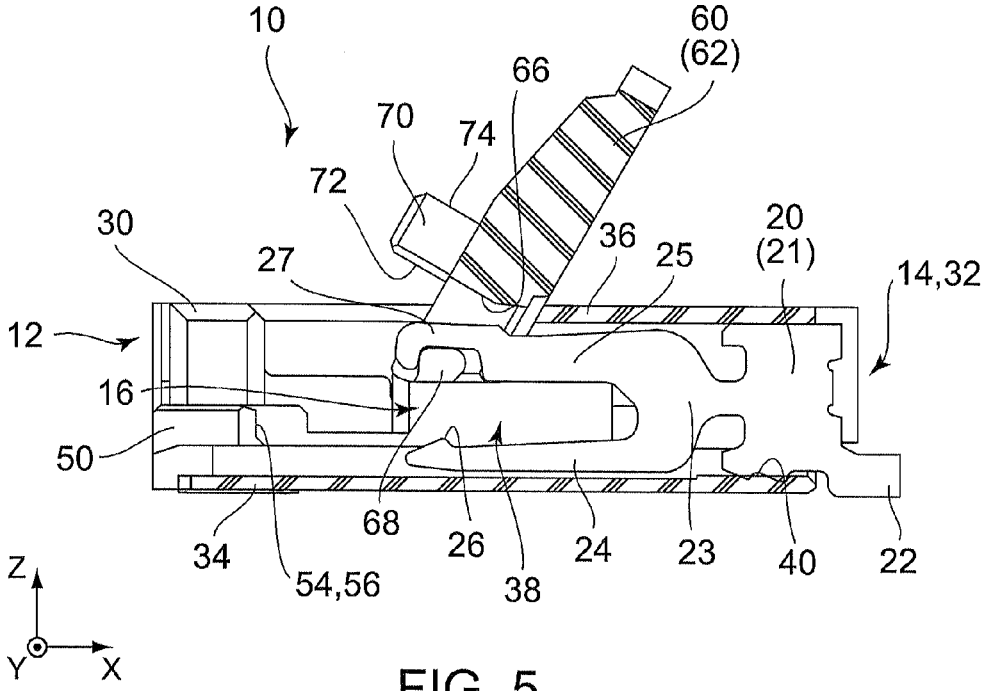
FIG. 5 is a cross-sectional view showing the connector of FIG. 3, taken along line A-A, wherein the illustrated pressing member is, however, positioned at the open position.
Figure 6:
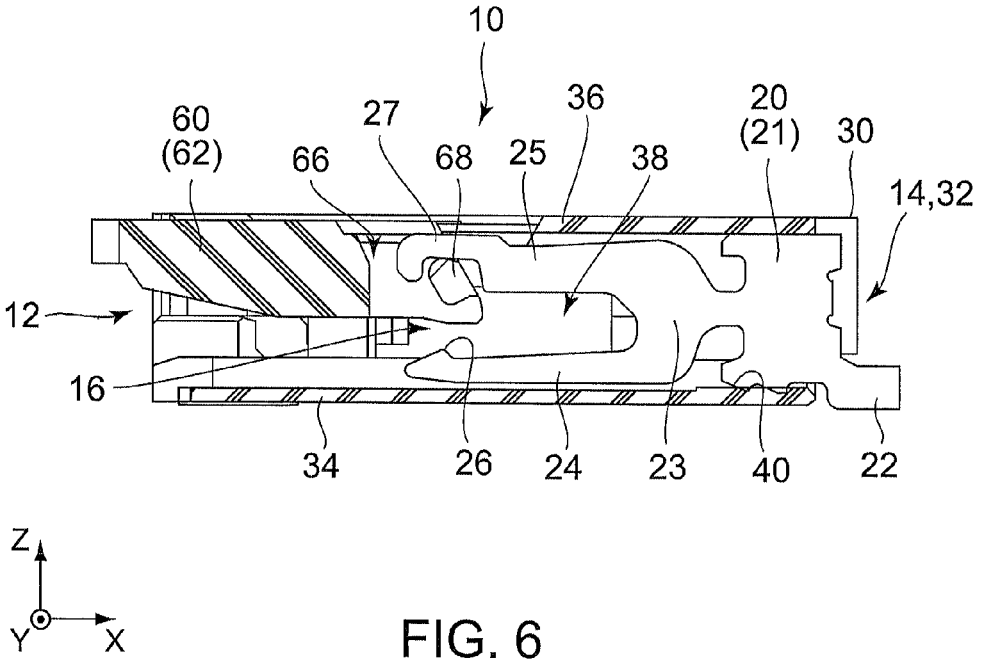
FIG. 6 is a cross-sectional view showing the connector of FIG. 5, wherein the illustrated pressing member is positioned at the close position.
Figure 10:
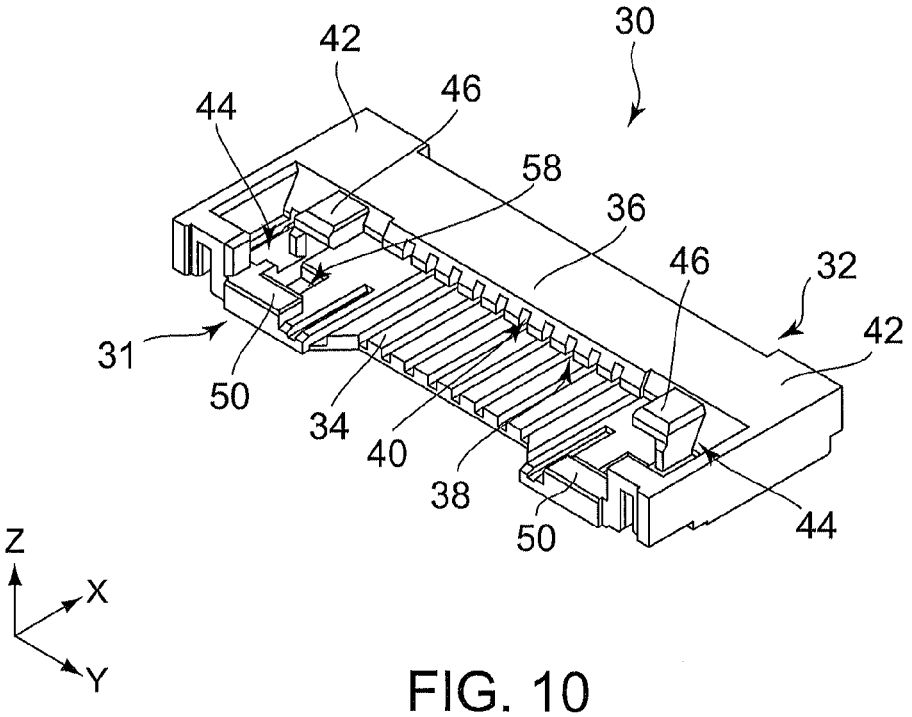
FIG. 10 is a perspective view showing a holding member which is included in the connector of FIG. 1.
Figure 11:
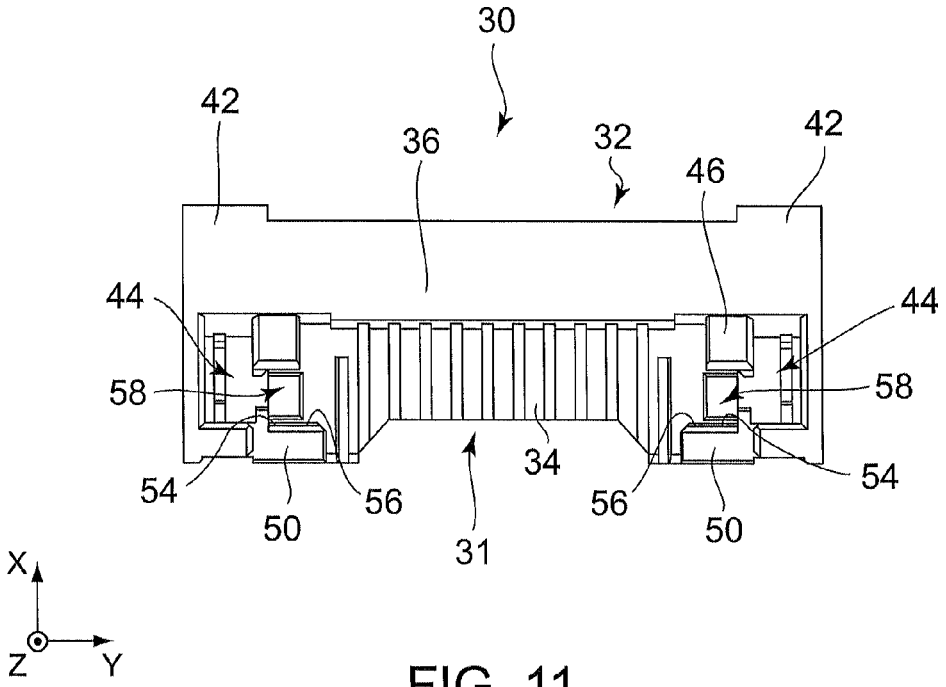
FIG. 11 is a top view showing the holding member of the FIG. 10.
Figure 12:
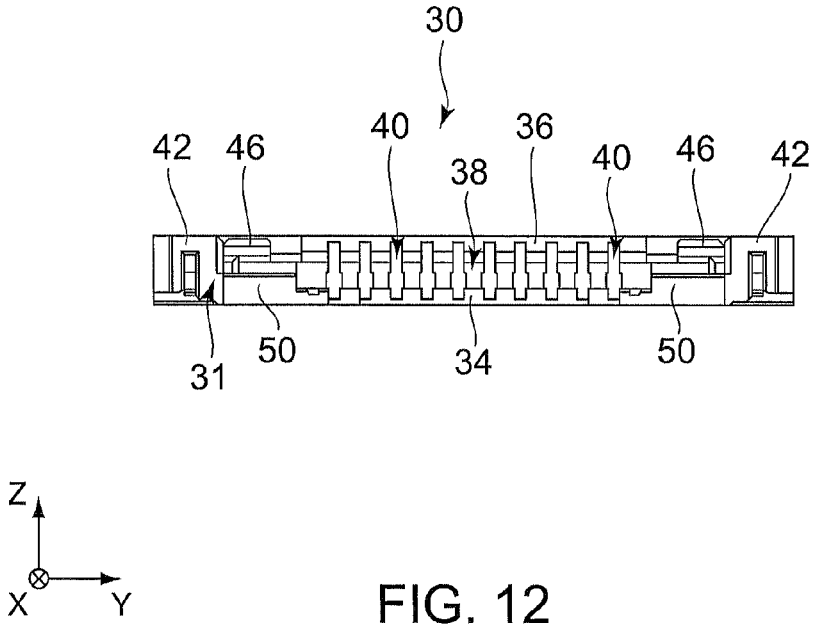
FIG. 12 is a front view showing the holding member of FIG. 10.

With reference to FIGS. 10 to 12, the holding member 30 has a bottom portion 34, a top portion 36 and two side portions 42. The bottom portion 34 of the present embodiment is larger than the top portion 36 in an XY-plane, or a horizontal plane which is defined by the front-rear direction and the pitch direction. The holding member 30 has a rear end 32, or a positive X-side end, in the front-rear direction, or the X-direction. The bottom portion 34 and the top portion 36 are connected with each other at a side of the rear end 32 of the holding member 30 in an up-down direction, or in a Z-direction. A front half part of the top portion 36 is positioned away from the bottom portion 34 in the up-down direction. The holding member 30 is formed with an accommodation portion 38 between the top portion 36 and the bottom portion 34. As understood from FIGS. 10 and 12, the holding member 30 is formed with a plurality of holding portions 40. The holding portions 40 are arranged in the pitch direction. As shown in FIGS. 5 and 6, each of the holding portions 40 pierces the holding member 30 in the front-rear direction and reaches the bottom portion 34 and the top portion 36.

With reference to FIGS. 10 and 11, the bottom portion 34 is formed with two upward protrusions 50 and two relief holes 58. One of the upward protrusions 50 and one of the relief holes 58 constitute one pair, and a remaining one of the upward protrusions 50 and a remaining one of the relief holes 58 constitute the other pair. The one pair of the upward protrusion 50 and the relief hole 58 is positioned in the vicinity of one of the two side portions 42, while the other pair of the upward protrusion 50 and the relief hole 58 is positioned in the vicinity of a remaining one of the two side portions 42.

Figure 4:
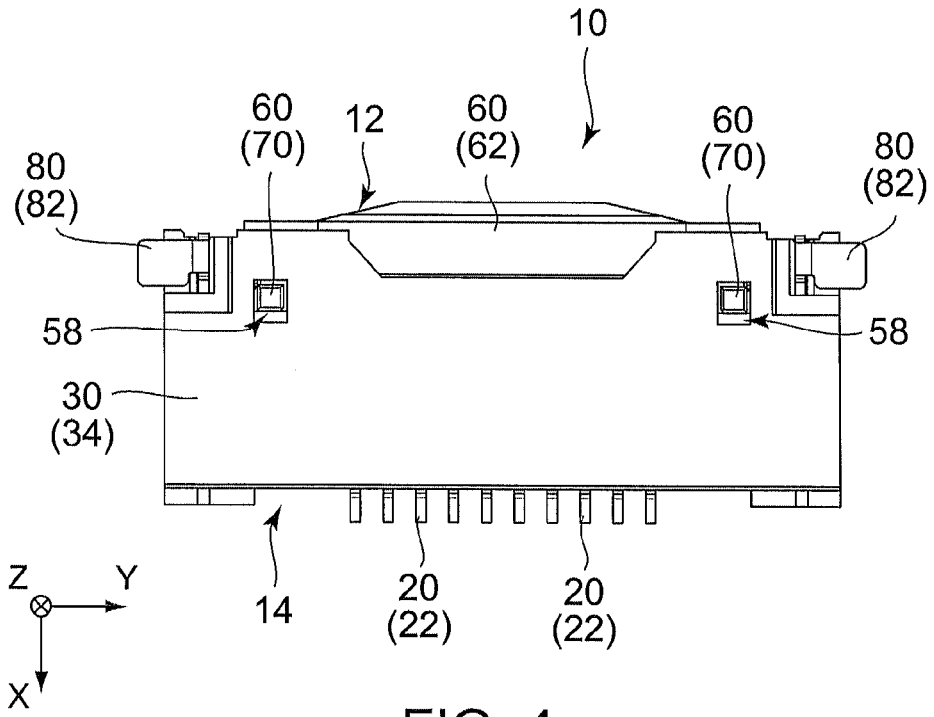
FIG. 4 is a bottom view showing the connector of FIG. 2.
Figure 7:
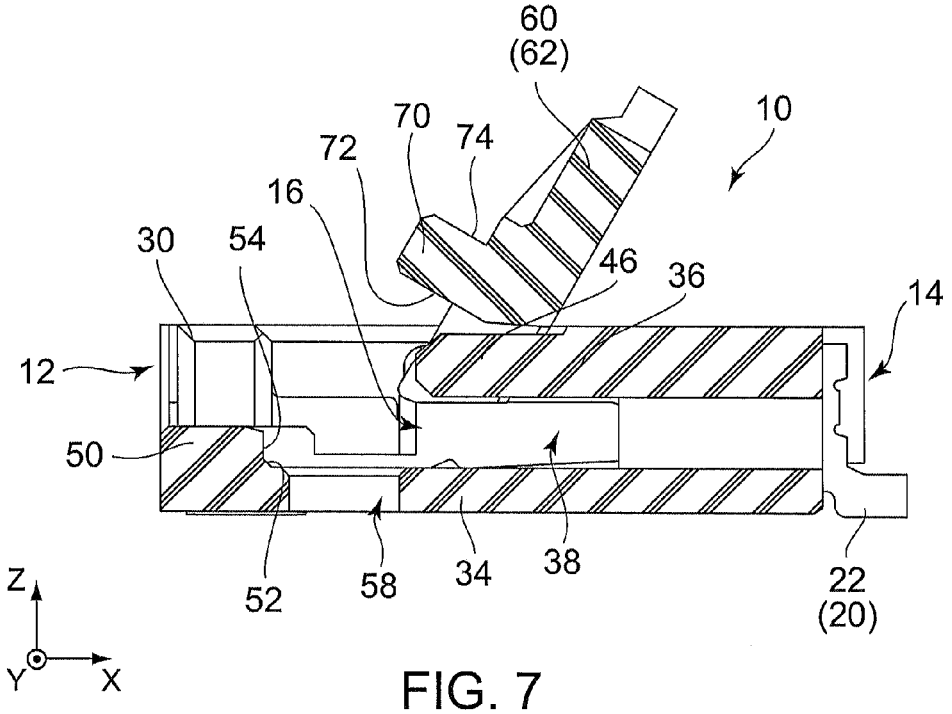
FIG. 7 is a cross-sectional view showing the connector of FIG. 3, taken along line B-B, wherein the illustrated pressing member is, however, positioned at the open position.
Figure 8:
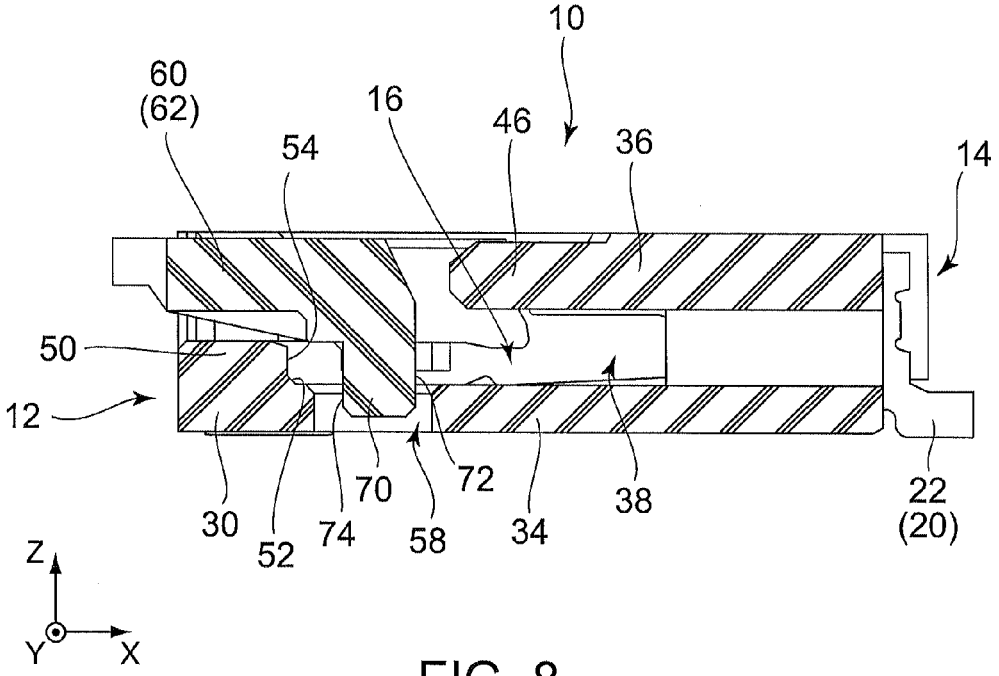
FIG. 8 is a cross-sectional view showing the connector of FIG. 7, wherein the illustrated pressing member is positioned at the close position.
Figure 9:
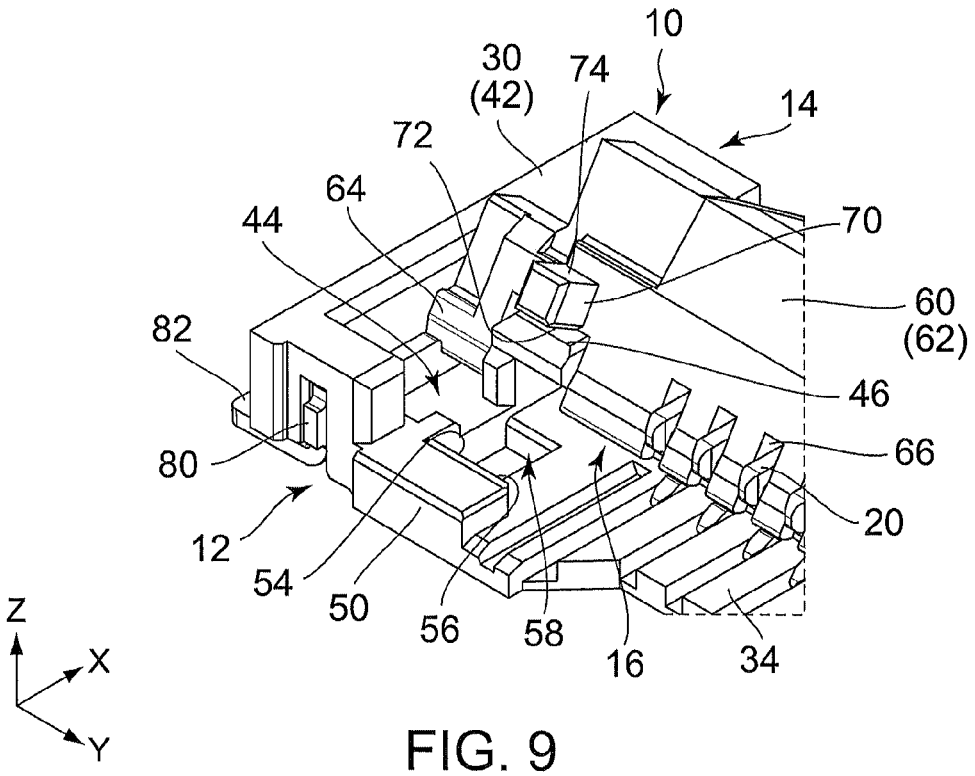
FIG. 9 is an enlarged, perspective view showing a part of the connector of FIG. 1.

The holding member 30 has a front end 31, or a negative X-side end, in the front-rear direction, or the X-direction. As shown in FIGS. 10 and 11, each of the upward protrusions 50 of the present embodiment is positioned in the vicinity of the front end 31 of the holding member 30, and each of the relief holes 58 is farther away from the front end 31 than the upward protrusion 50 paired therewith. Specifically, each of the relief holes 58 is positioned rearward of the upward protrusion 50 paired therewith. As shown in FIG. 9, each of the upward protrusions 50 protrudes upward, or a positive Z-direction, and has a rectangular shape extending long in the pitch direction in the horizontal plane. As shown in FIGS. 4, 7 and 8, each of the relief holes 58 pierces the bottom portion 34 in the up-down direction. As shown in FIG. 11, a rear surface, or a surface facing rearward, of each of the upward protrusions 50 functions as a regulating portion 54 and a temporarily holding portion 56. Specifically, each pair of the regulating portion 54 and the temporarily holding portion 56 of the present embodiment is formed as a part of the upward protrusion 50 corresponding thereto. As described above, the regulating portion 54 of the present embodiment is formed at the common protrusion where the temporarily holding portion 56 is formed. However, the present invention is not limited thereto. The regulating portion 54 and the temporarily holding portion 56, which are paired with each other, may be formed at independent protrusions, respectively. In addition, each of the regulating portion 54 and the temporarily holding portion 56 of the present embodiment has a plane.

As shown in FIG. 11, each of the regulating portions 54 is positioned at the same position as the relief hole 58 paired therewith in the pitch direction, and each of the temporarily holding portions 56 is positioned inward of the regulating portion 54 of the common upward protrusion 50 in the pitch direction. As shown FIGS. 7 and 8, each of the upward protrusions 50 is positioned away from the relief hole 58 paired therewith in the front-rear direction, and each of the regulating portions 54 is positioned away from an inner surface of the relief hole 58 paired therewith. In addition, the regulating portion 54 of each of the upward protrusions 50 has a base 52 which intersects with both the front-rear direction and the up-down direction. Specifically, the base 52 of the regulating portion 54 of each of the upward protrusions 50 makes a slope extending downward and outward.

As shown in FIG. 10, the holding member 30 is further formed with two suppressing portions 46. The two suppressing portions 46 are positioned away from each other in the pitch direction. Each of the suppressing portions 46 is positioned away from the bottom portion 34 in the up-down direction and protrudes forward from the top portion 36 in the front-rear direction. As understood from FIGS. 15 and 17, each of the suppressing portions 46 is positioned upward of the object 100 in the up-down direction when the object 100 is inserted into the connector 10. Accordingly, the suppressing portions 46 can suppress upward movement of the object 100. The suppressing portions 46 correspond to the relief holes 58, respectively. In addition, the suppressing portions 46 correspond to the upward protrusions 50, respectively. As understood from FIG. 11, in the pitch direction, each of the suppressing portions 46 of the present embodiment is positioned at a position same as both a position of the corresponding relief hole 58 and a position of the corresponding upward protrusion 50. However, the present invention is not limited thereto. Each of the suppressing portions 46 may be positioned inward of the corresponding upward protrusion 50 in the pitch direction. Although the number of the suppressing portions 46 of the present embodiment is two, the number of the suppressing portions 46 is not limited in the present invention. However, considering effective suppression of movement of the object 100 as shown in FIG. 15, it is preferable that the holding member 30 is formed with a plurality of the suppressing portions 46.

Figure 2:
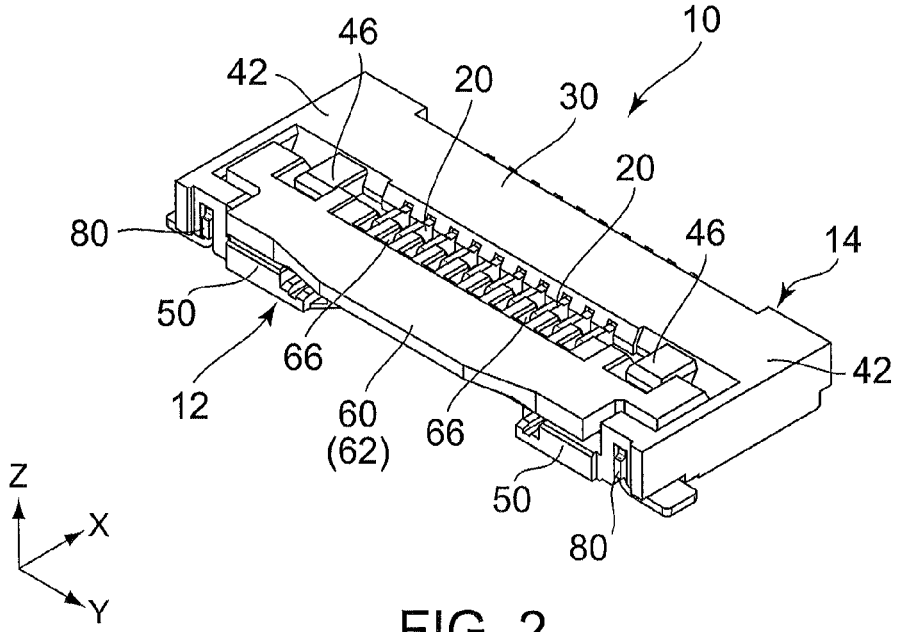
FIG. 2 is another perspective view showing the connector of FIG. 1, wherein the illustrated pressing member is positioned at a close position.

As shown in FIGS. 1, 2 and 9, the holddowns 80 are held by the side portions 42, respectively. Each of the holddowns 80 has a fixed portion 82 which is fixed to a circuit board (not shown) when the connector 10 is mounted on the circuit board. As shown in FIGS. 10 and 11, each of the side portions 42 is formed with a side accommodation portion 44.

Figure 3:
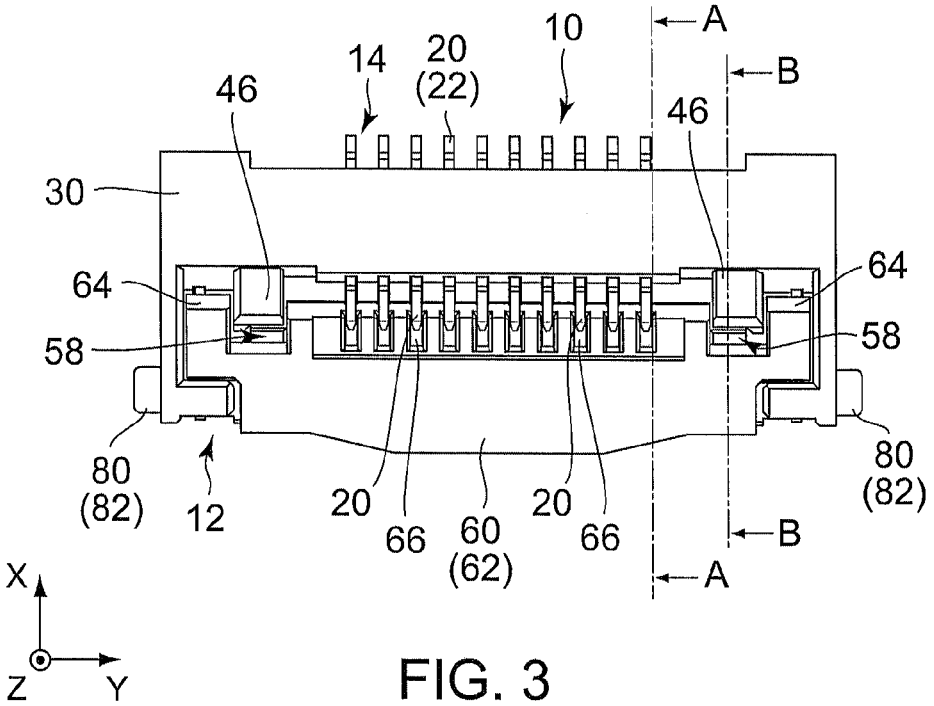
FIG. 3 is a top view showing the connector of FIG. 2.

As understood from FIGS. 3, 5 and 6, the terminals 20 are held by the holding portions 40 of the holding member 30, respectively.

Figure 13:
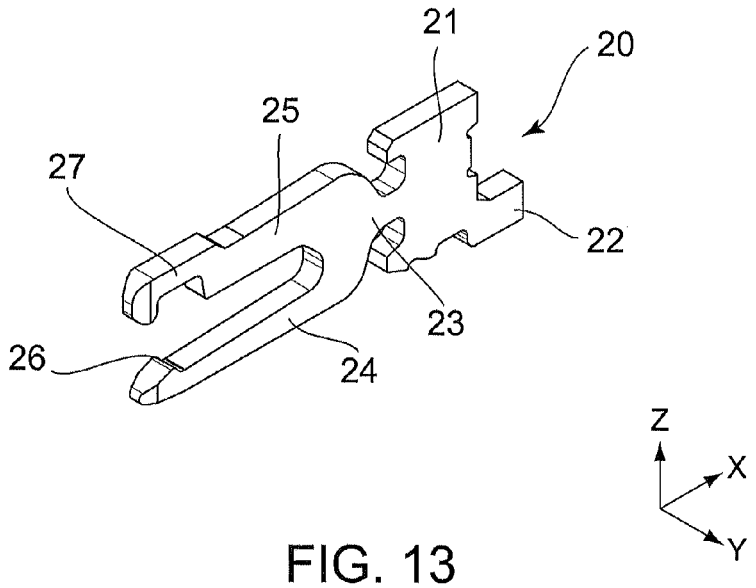
FIG. 13 is a perspective view showing a terminal which is included in the connector of FIG. 1.

As shown in FIGS. 5, 6 and 13, each of the terminals 20 has a held portion 21, a fixed portion 22, a coupling portion 23, a lower-jaw portion 24 and an upper-jaw portion 25. The held portions 21 are press-fit into the holding portions 40 of the holding member 30 from the rear end 32 of the holding member 30 to be held by the holding portions 40, respectively. The fixed portion 22 extends rearward, or in a positive X-direction, from the held portion 21. The fixed portion 22 is a portion which is fixed to the circuit board (not shown) when the connector 10 is mounted on the circuit board. The coupling portion 23 extends forward, or in a negative X-direction, from the held portion 21 and is then forked into two branches. Each of the lower-jaw portion 24 and the upper-jaw portion 25 extends forward from the coupling portion 23. In other words, the lower-jaw portions 24 and the upper-jaw portion 25 are coupled with each other by the coupling portion 23. The lower-jaw portion 24 is provided with a contact point 26 which is brought into contact with the connection portion 112 of the object 100 when the connector 10 is connected with the object 100 as shown in FIG. 14. The upper-jaw portion 25 is provided with a cam holding portion 27. The cam holding portion 27 has a shape which is recessed upward.

As shown in FIG. 1, the pressing member 60 has a main portion 62 and two side end portions 64. The side end portions 64 are positioned at opposite ends, respectively, of the main portion 62 in the pitch direction.

As shown in FIGS. 1 to 3, the main portion 62 is formed with a plurality of ditches 66. The ditches 66 correspond to the terminals 20, respectively. As shown in FIGS. 5 and 6, each of the ditches 66 is formed with a cam portion 68 which is positioned inside thereof. The aforementioned cam holding portion 27 of each of the terminals 20 is positioned upward of the corresponding cam portion 68 in the corresponding ditch 66. Since each of the cam holding portions 27 is not fixed to the corresponding cam portion 68, each of the cam portions 68 is rotatable. In other words, each of the cam portions 68 is held by the corresponding cam holding portion 27 so as to be rotatable.

As shown in FIGS. 1 and 9, the side end portions 64 are accommodated in the side accommodation portions 44 of the holding member 30, respectively. Specifically, the side end portions 64 are supported by the holding member 30 and the holddowns 80 in the side accommodation portions 44, respectively. As a result, the main portion 62 forms an insertion opening 16 in cooperation with the bottom portion 34 of the holding member 30.

Each of the cam portions 68 is held by the corresponding cam holding portion 27 as shown in FIGS. 5 and 6, and each of the side end portions 64 is held by the holding member 30 and the corresponding holddown 80 as shown in FIGS. 1 and 9. Thus, the pressing member 60 can be moved such as being rotated on the cam portions 68. In addition, each of the cam portions 68 is configured to be loosely held by the corresponding cam holding portion 27 in the front-rear direction as shown in FIGS. 5 and 6, and each of the side end portions 64 is configured to be loosely held by the holding member 30 and the corresponding holddown 80 in the front-rear direction as shown in FIGS. 1 and 9. Thus, the pressing member 60 of the present embodiment is movable to a limited extent also in the front-rear direction.

In the present embodiment, the pressing member 60 is positioned at a first position when opened as shown in FIG. 5, and the pressing member 60 is positioned at a second position when closed as shown in FIG. 6. The first position is referred to as "open position", and the second position is referred to as "close position". The pressing member 60 according to the present embodiment is movable between the open position and the close position, and is movable to the close position by being turned forward, or toward a front end 12 of the connector 10, from the open position. Specifically, the connector 10 of the present embodiment is a so-called front-flip connector. As understood from FIGS. 5 and 6, a distance between the pressing member 60 positioned at the close position and each of the contact points 26 is shorter than another distance between the pressing member 60 positioned at the open position and each of the contact points 26.

As shown in FIGS. 1, 7 and 8, the pressing member 60 is provided with two downward protrusions 70. As shown in FIG. 1, the downward protrusions 70 are positioned in the vicinities of the opposite ends, respectively, of the main portion 62 in the pitch direction. As shown in FIG. 8, when the pressing member 60 is positioned at the close position, each of the downward protrusions 70 protrudes downward. When the pressing member 60 is positioned at the close position, the downward protrusions 70 of the present embodiment are partially received in the relief holes 58, respectively.

As understood from FIGS. 8 and 9, each of the downward protrusions 70 of the pressing member 60 which is positioned at the close position does not overlap with any of the temporarily holding portions 56 of the holding member 30 in the pitch direction. In other words, when the pressing member 60 is positioned at the close position, each of the temporarily holding portions 56 is positioned at a position different from another position of any of the downward protrusions 70 in the pitch direction.

As understood from FIGS. 9 and 11, in the pitch direction, each of the downward protrusions 70 is smaller than any of the upward protrusions 50. Specifically, in the pitch direction, each of the upward protrusions 50 has a size larger than another size of any of the downward protrusions 70.

As shown in FIGS. 7 to 9, each of the downward protrusions 70 is provided with a receiving portion 72 and a regulated portion 74. The receiving portion 72 of the present embodiment is a rearward plane of the downward protrusion 70 when the pressing member 60 is positioned at the close position. The rearward plane of the downward protrusion 70 is a plane thereof which faces toward a rear end 14 of the connector 10. On the other hand, the regulated portion 74 of the present embodiment is a forward plane of the downward protrusion 70 when the pressing member 60 is positioned at the close position. The forward plane of the downward protrusion 70 is a plane thereof which faces toward the front end 12 of the connector 10. Thus, each pair of the receiving portion 72 and the regulated portion 74 of the present embodiment is formed as a part of the downward protrusion 70 corresponding thereto. However, the present invention is not limited thereto. For example, the receiving portion 72 and the regulated portion 74, which are paired with each other, may be formed as parts of independent protrusions, respectively.

As understood from FIGS. 1, 14 and 15, the object 100 is connected with the connector 10 as follows. After the pressing member 60 is positioned at the open position, the end portion 102 of the object 100 is inserted rearward from the insertion opening 16 so that the object 100 is accommodated in the accommodation portion 38, as shown in FIG. 5, of the holding member 30. Thereafter, the pressing member 60 is turned forward to be moved to the close position as shown in FIGS. 2 and 16 so that the pressing member 60 presses the object 100 against the contact points 26, as shown in FIG. 6, of the terminals 20.

Figure 17:
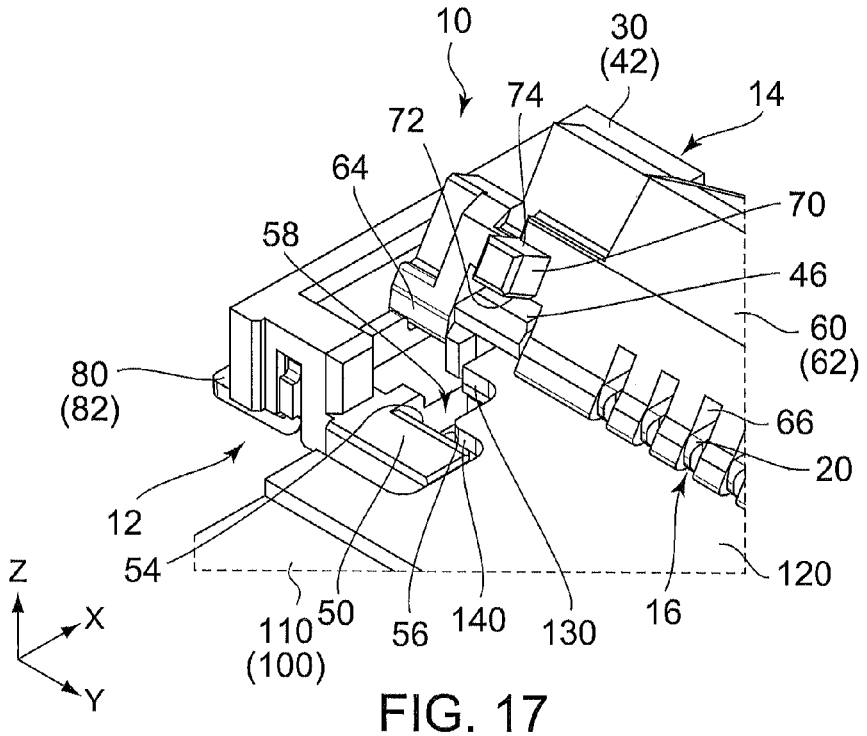
FIG. 17 is an enlarged, perspective view showing a part of the connector of FIG. 15.

As understood from FIGS. 15 and 17, when the object 100 is inserted into the connector 10 while the pressing member 60 is positioned at the open position, the temporarily holding portions 56 are positioned between the temporarily held portions 140 and the front end 12 of the connector 10, respectively. Specifically, when the object 100 is inserted into the connector 10 while the pressing member 60 is positioned at the open position, each of the temporarily holding portions 56 is positioned forward of the corresponding temporarily held portion 140 in the front-rear direction. Accordingly, even if the connector 10 is tilted, the object 100 can be prevented from being removed and dropped down from the connector 10.

As understood from FIGS. 7, 8 and 15 to 17, when the object 100 is connected with the connector 10 while the pressing member 60 is positioned at the close position, the receiving portions 72 are positioned between the front end 12 of the connector 10 and the received portions 130, respectively. Specifically, when the object 100 is connected with the connector 10 while the pressing member 60 is positioned at the close position, each of the receiving portions 72 is positioned forward of the corresponding received portion 130 of the object 100 in the front-rear direction. Accordingly, even if the object 100 is to be pulled out upward or obliquely upward in order to be removed from the connector 10 in an unfavorable manner, each of the received portions 130 is obstructed by the corresponding receiving portion 72 so that the unfavorable removal of the object 100 can be prevented.

As described above, when the pressing member 60 is positioned at the close position, the pressing member 60 is movable in the front-rear direction to some extent. In the present embodiment, when the pressing member 60 is positioned at the close position, the regulated portions 74 are positioned between the rear end 14 of the connector 10 and the regulating portions 54, respectively, as shown in FIG. 8. Specifically, when the pressing member 60 is positioned at the close position, each of the regulated portions 74 is positioned rearward of the corresponding regulating portion 54 in the front-rear direction. Accordingly, each of the regulating portions 54 can regulate excessive forward movement of the corresponding regulated portion 74 by receiving the corresponding regulated portion 74.

As understood from FIGS. 8 and 17, when the object 100 is connected with the connector 10 while the pressing member 60 is positioned at the close position, the downward protrusions 70 of the present embodiment are positioned between the received portions 130 and the regulating portions 54, respectively, in the front-rear direction. Accordingly, even in a case where a momentum which urges the pressing member 60 to be moved toward the open position is about to be generated by pulling the object 100 forward or obliquely forward, each of the regulated portions 74 is brought into abutment with the corresponding regulating portion 54 so that the pressing member 60 can be prevented from being opened. In the present embodiment, each of the illustrated regulated portions 74 is brought into line contact with the corresponding regulating portion 54 so that movements of the regulated portions 74 are regulated.

Figure 18:
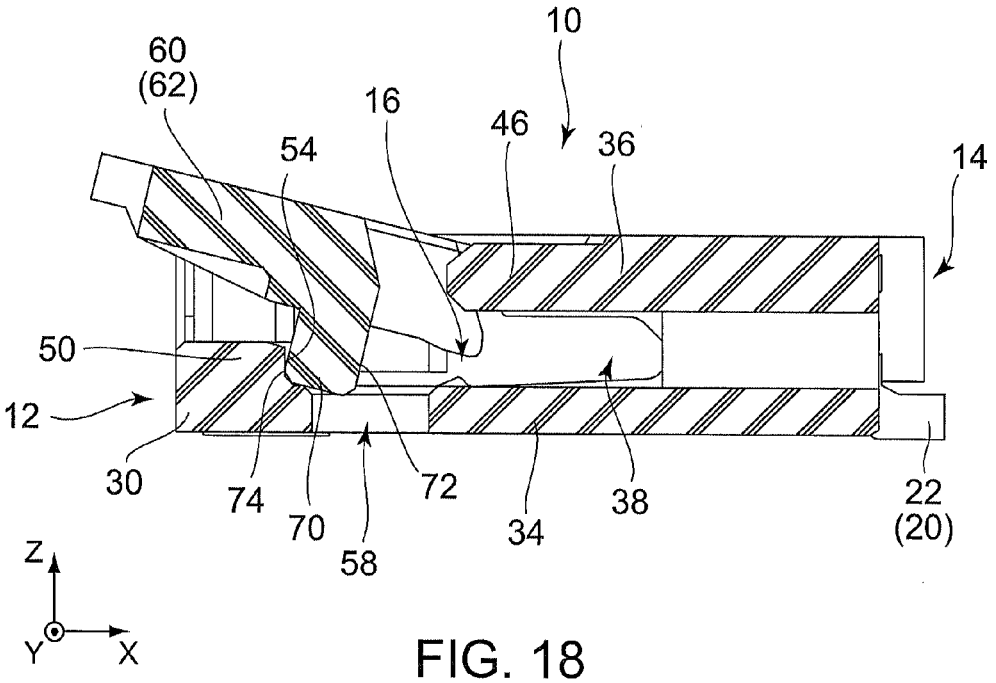
FIG. 18 is a cross-sectional view showing the connector of FIG. 7, wherein the cross-sectional view is used for explanation about regulation of movement of a regulated portion by a regulating portion.
Figure 19:
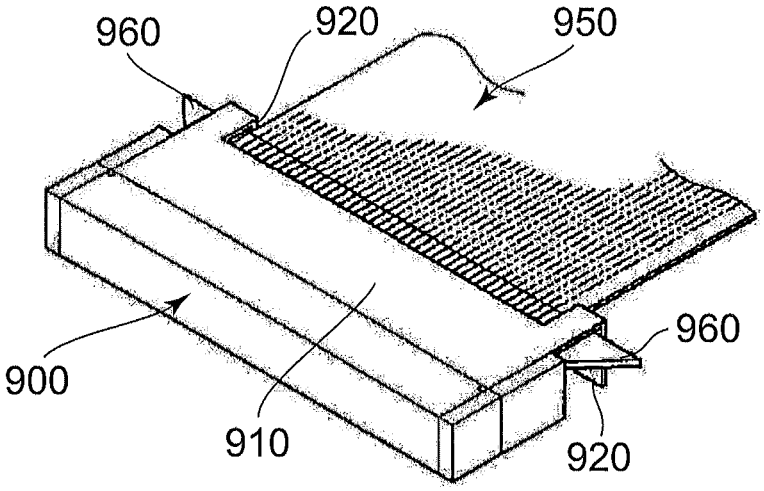
FIG. 19 PRIOR ART
FIG. 19 is a perspective view showing a connector of Patent Document 1, wherein the illustrated connector is connected with a cable.
Figure 20:
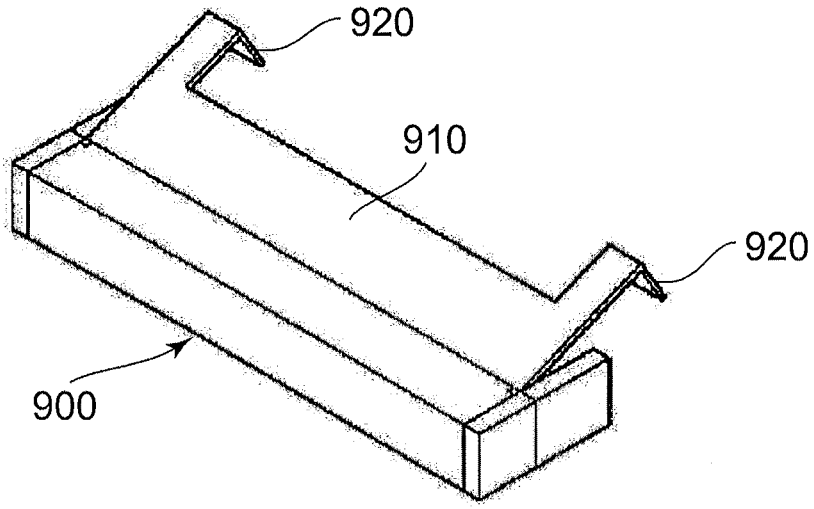
FIG. 20 PRIOR ART
FIG. 20 is a perspective view showing the connector of FIG. 19, wherein the cable is not shown therein.
Figure 21:
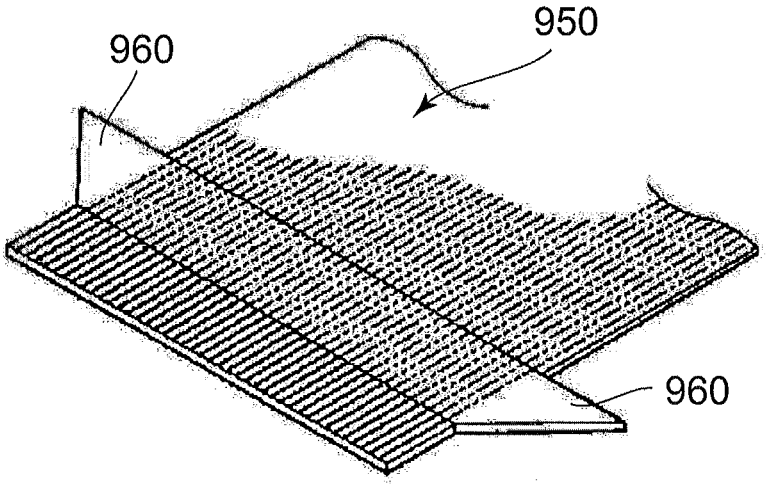
FIG. 21 PRIOR ART
FIG. 21 is a perspective view showing the cable of FIG. 19.

For example, when each of the regulated portions 74 is brought into abutment with the corresponding regulating portion 54 as shown in FIG. 18, stresses are applied to the bases 52 of the regulating portions 54 of the upward protrusions 50, respectively. Since the base 52 of each of the regulating portions 54 of the upward protrusions 50 of the present embodiment intersects with both the front-rear direction and the up-down direction as shown in FIGS. 7 and 8, the stresses can be dispersed as compared with a case where each of the bases 52 is perpendicular to the front-rear direction. Thus, according to the present embodiment, the holding member 30 can be prevented from being broken in the vicinities of the upward protrusions 50.

Although the above explanation is made specifically with the embodiment of the present invention, the present invention is not limited thereto. The present invention can be variously modified. For example, the present invention does not limit the shapes of the terminals 20 and the pressing member 60. In addition, the present invention does not limit the specific supporting structure which supports the pressing member 60, provided that the pressing member 60 is supported by at least one of a set of the terminals 20 and the holding member 30 so as to perform combined movement which is composed of rotational movement and movement in the front-rear direction.

In the aforementioned embodiment, each of the regulated portions 74 is brought into line contact with the corresponding regulating portion 54 as shown in FIG. 18. Each of the regulated portions 74 may however be brought into surface contact with the corresponding regulating portion 54. Specifically, the plane of each of the regulated portions 74 may be brought into surface contact with the plane of the corresponding regulating portion 54 so that each of the regulating portions 54 regulates forward movement of the corresponding regulated portion 74 and so that the pressing member 60 is prevented from being opened. In addition, for example, movement of the regulated portion 74 may be regulated as follows. One of the regulating portion 54 and the regulated portion 74 has a concave surface, and a remaining one thereof has a convex surface. The concave surface and the convex surface are brought into surface contact with each other.

The present application is based on a Japanese patent application of JP2014-230508 filed before the Japan Patent Office on Nov. 13, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector connectable with a sheet-like object having a received portion, the connector comprising a terminal, a holding member and a pressing member, wherein:

the holding member holds the terminal;

the holding member has a regulating portion;

the pressing member is supported by at least one of the terminal and the holding member so as to be movable;

the pressing member is movable between an open position and a close position and is movable to the close position by being turned forward in a front-rear direction from the open position;

the pressing member is provided with a receiving portion and a regulated portion;

the receiving portion is positioned forward of the received portion of the object in the front-rear direction when the object is connected with the connector while the pressing member is positioned at the close position;

when the pressing member is positioned at the close position, the regulated portion is positioned rearward of the regulating portion in the front-rear direction so that the regulating portion regulates forward movement of the regulated portion;

the pressing member is provided with a downward protrusion;

each of the receiving portion and the regulated portion is formed as a part of the downward protrusion;

the downward protrusion protrudes downward in an up-down direction perpendicular to the front-rear direction when the pressing member is positioned at the close position; and the downward protrusion is positioned between the received portion and the regulating portion in the front-rear direction when the object is connected with the connector while the pressing member is positioned at the close position;

the object is provided with a temporarily held portion;

the holding member is provided with a temporarily holding portion; and the temporarily holding portion is positioned forward of the temporarily held portion in the front-rear direction when the object is inserted into the connector while the pressing member is positioned at the open position.

2. The connector as recited in claim 1, wherein the regulating portion regulates forward movement of the regulated portion by receiving the regulated portion.

3. The connector as recited in claim 1, wherein:

the holding member is formed with a relief hole; and the relief hole partially receives the downward protrusion when the pressing member is positioned at the close position.

4. The connector as recited in claim 3, wherein:

the regulating portion is positioned away from the relief hole in the front-rear direction; and the regulating portion has a base which intersects with both the front-rear direction and the up-down direction.

5. The connector as recited in claim 1, wherein, when the pressing member is positioned at the close position, the temporarily holding portion is positioned at a position different from another position of the downward protrusion in a pitch direction perpendicular to both the front-rear direction and the up-down direction.

6. The connector as recited in claim 5, wherein:

the holding member is formed with an upward protrusion which protrudes upward in the up-down direction;

in the pitch direction, the upward protrusion has a size larger than another size of the downward protrusion; and each of the regulating portion and the temporarily holding portion is formed as a part of the upward protrusion.

7. The connector as recited in claim 1, wherein:

the holding member is formed with a suppressing portion; and when the object is inserted into the connector, the suppressing portion is positioned upward of the object in an up-down direction perpendicular to the front-rear direction to suppress upward movement of the object.

* * * * *